US012012821B2

(12) United States Patent
Christiansen

(10) Patent No.: US 12,012,821 B2
(45) Date of Patent: Jun. 18, 2024

(54) PACKER SHEAR BRIDGE

(71) Applicant: Schlumberger Technology Corporation, Sugar Land, TX (US)

(72) Inventor: Brian Christiansen, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/006,160

(22) PCT Filed: Jul. 20, 2021

(86) PCT No.: PCT/US2021/042289

§ 371 (c)(1),
(2) Date: Jan. 20, 2023

(87) PCT Pub. No.: WO2022/020294

PCT Pub. Date: Jan. 27, 2022

(65) Prior Publication Data

US 2023/0295995 A1 Sep. 21, 2023

Related U.S. Application Data

(60) Provisional application No. 63/054,915, filed on Jul. 22, 2020.

(51) Int. Cl.
*E21B 33/129* (2006.01)
*E21B 29/00* (2006.01)

(52) U.S. Cl.
CPC ..... *E21B 33/129* (2013.01); *E21B 29/002* (2013.01)

(58) Field of Classification Search
CPC ..... E21B 29/002; E21B 33/127; E21B 33/129
See application file for complete search history.

(56) References Cited

U.S. PATENT DOCUMENTS

| | | | | |
|---|---|---|---|---|
| 10,435,982 | B2 * | 10/2019 | Shkurti | E21B 33/129 |
| 11,162,345 | B2 * | 11/2021 | Ring | E21B 33/1293 |
| 2004/0069502 | A1 | 4/2004 | Luke | |
| 2016/0290095 | A1 | 10/2016 | Cromer | |
| 2016/0356116 | A1 | 12/2016 | Hern | |
| 2017/0058630 | A1 | 3/2017 | Limb | |
| 2023/0295995 | A1 * | 9/2023 | Christiansen | E21B 33/127 166/376 |

FOREIGN PATENT DOCUMENTS

| | | | | |
|---|---|---|---|---|
| WO | 2011015835 | A1 | 2/2011 | |
| WO | WO-2011015835 | A1 * | 2/2011 | E21B 33/1204 |

OTHER PUBLICATIONS

International Search Report and Written Opinion issued in the PCT Application PCT/US2021/042289, dated Oct. 25, 2021 (9 pages).
International Preliminary Report on Patentability issued in PCT Application PCT/US2021/042289 dated Feb. 2, 2023, 6 pages.

* cited by examiner

*Primary Examiner* — Daniel P Stephenson
(74) *Attorney, Agent, or Firm* — Jeffrey D. Frantz

(57) ABSTRACT

A tool assembly includes a body, a slip cage disposed about the body, a cone slidable in a longitudinal direction along a length of the body, and a shear bridge. The slip cage carries a plurality of slips. The cone includes a ramp that facilitates radial outward expansion of the plurality of slips. The shear bridge connects the cone and the slip cage via a plurality of shear fasteners.

8 Claims, 1 Drawing Sheet

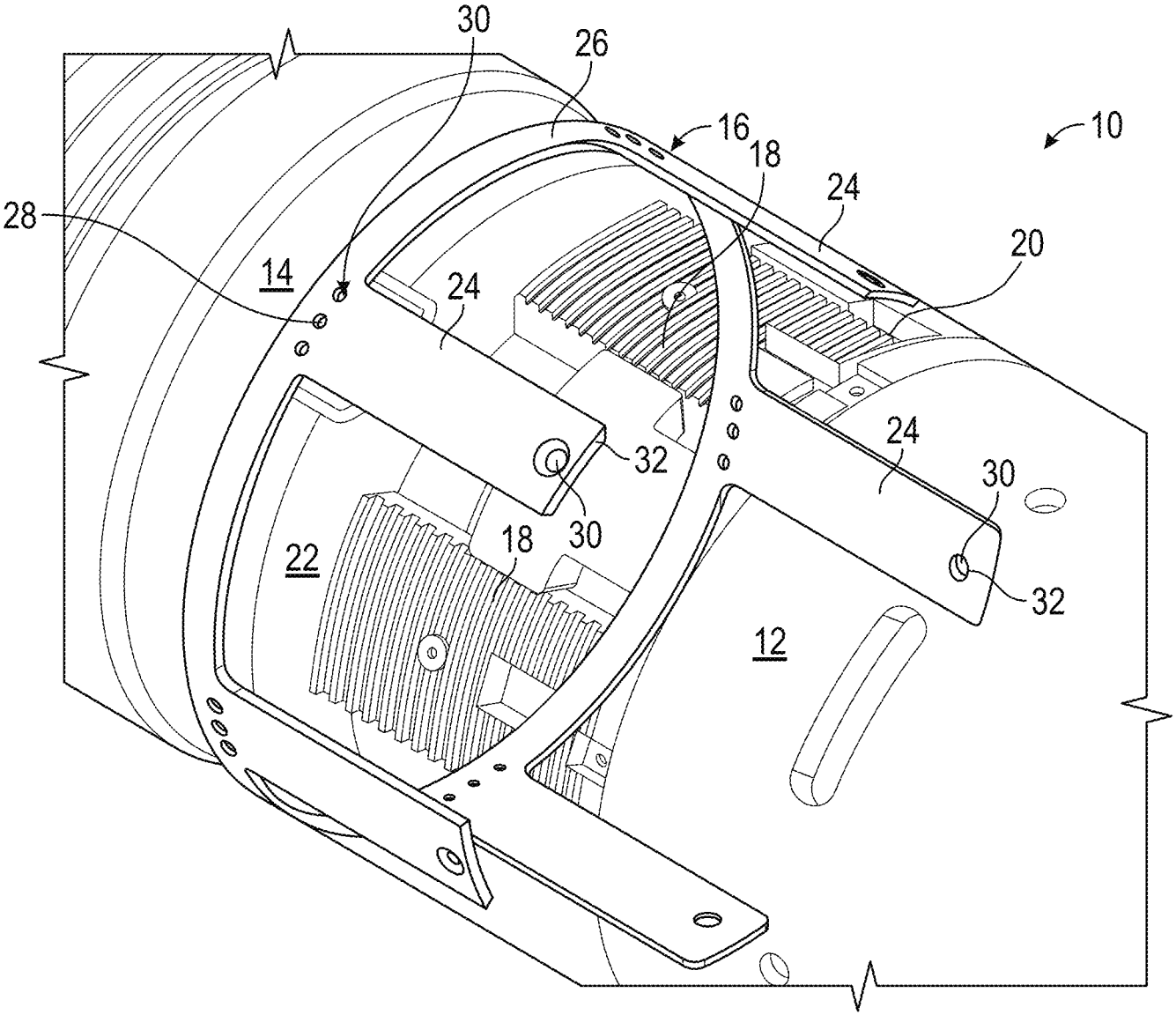
10
20
24
16
18
26
30
28
14
24
32
30
22
18
24
30
32
12

PACKER SHEAR BRIDGE

CROSS-REFERENCE TO RELATED APPLICATION

The present document is a National Stage Entry of International Application No. PCT/US2021/042289, filed Jul. 20, 2021, which is based on and claims priority to U.S. Provisional Patent Application Ser. No. 63/054,915, filed Jul. 22, 2020, which is incorporated herein by reference in its entirety.

BACKGROUND

Packers are generally utilized in wellbore operations to provide a seal (e.g., an annular seal) or barrier to fluid flow across an annulus formed between an inner casing and the wall of the wellbore. Packer slips, an essential component of a packer design, anchor the packer to the casing. Slips are typically actuated by expanding radially outward on an angled ramp (e.g., cone), and the slips may have sharp teeth for biting into the casing. In some packer designs, simply fastening a packer slip to the cone prior to setting has proven to be unworkable to prevent premature actuation. Therefore, there is a need to facilitate connecting the packer slips to the cone for transport, etc. prior to actuation of the packer slips.

SUMMARY

A tool assembly according to one or more embodiments of the present disclosure includes a body, a slip cage disposed about the body, the slip cage carrying a plurality of slips, a cone slidable in a longitudinal direction along a length of the body, the cone including: a ramp that facilitates radial outward expansion of the plurality of slips, and a shear bridge that connects the cone and the slip cage via a plurality of shear fasteners.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying FIGURES illustrate the various implementations described herein and are not meant to limit the scope of various technologies described herein, and:

FIG. 1 shows a perspective view of a shear bridge according to one or more embodiments of the present disclosure.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," "left" and "right," and other like terms indicating relative positions above or below a given point or element are used in this description to more clearly describe some embodiments of the disclosure.

The present disclosure generally relates to a tool assembly that may be deployed into a wellbore to facilitate wellbore operations. More specifically, one or more embodiments of the present disclosure relate to a tool assembly, such as a packer assembly, that implements a shear bridge, and a method of setting the same.

In some packer applications, packer slips may be directly fastened to a cone via a shear screw to lock the packer in its assembled configuration during transport (e.g., deployment, run-in-hole, etc.) and to prevent premature actuation of the slips. In some packer applications that implement single-ramp packer slips, however, directly fastening the packer slips to the cone may be unworkable due to the limited space remaining between the mandrel and casing. Accordingly, one or more embodiments of the present disclosure implements a shear bridge to facilitate connecting the packer slips to the cone.

Referring now to FIG. 1, a perspective view of a shear bridge according to one or more embodiments of the present disclosure is shown. Specifically, FIG. 1 shows a tool assembly 10, which may be a packer, for example, having a slip cage 12 disposed about a body (not shown), a cone 14, and a shear bridge 16. In one or more embodiments of the present disclosure, the slip cage 12 may carry a plurality of slips 18. Moreover, the cone 14 of the tool assembly 10 may include a cone ramp 22 that facilitates radial outward expansion of the plurality of slips 18.

Still referring to FIG. 1, the shear bridge 16 according to one or more embodiments of the present disclosure includes a plurality of bridge portions 24 joined together via a ring portion 26. While FIG. 1 shows that the shear bridge 16 includes five bridge portions 24, the shear bridge 16 may include any number of bridge portions 24 without departing from the scope of the present disclosure. As further shown in FIG. 1, in one or more embodiments of the present disclosure, the shear bridge 16 includes at least one hole 28 at an interface between the ring portion 26 and a given bridge portion 24 of the plurality of bridge portions 24. While FIG. 1 shows three holes 28 at the interface between the ring portion 26 and a given bridge portion 24, more or less holes 28 may be included at the interface without departing from the scope of the present disclosure. In one or more embodiments of the present disclosure, a shear fastener 30 may be disposed in the holes 28 at the interface between the ring portion 26 and a given bridge portion 24 of the plurality of bridge portions 24 for holding the shear bridge 16 axially to the cone 14. As further shown in FIG. 1, in one or more embodiments of the present disclosure, the shear bridge 16 includes a hole 32 near an end of a given bridge portion 24 that is opposite the ring portion 26. While FIG. 1 shows one hole 32 near the end of a given bridge portion 24 that is opposite the ring portion 26, more than one hole 32 may be included near the end of the bridge portion 24 without departing from the scope of the present disclosure. In one or more embodiments of the present disclosure, a shear fastener 30 may be disposed in the hole 32 near the end of a given bridge portion 24 that is opposite the ring portion 26 for fastening the bridge portion 24 of the shear bridge 16 to the slip cage 12. In this way, the shear bridge 16 according to one or more embodiments of the present disclosure connects the cone 14 and the slip cage 12 via a plurality of shear fasteners 30. According to one or more embodiments of the present disclosure, the shear fastener 30 may be a shear pin, a shear screw, or any type of fastener that is capable of shearing when exposed to a predetermined amount of pressure. In one or more embodiments of the present disclosure, the shear fasteners 30 disposed in the holes 28 at the interface between the ring portion 26 and a given bridge portion 24 of the plurality of bridge portions 24, and the shear fastener 30 disposed in the hole 32 near the end of a given bridge portion 24 that is opposite the ring portion 26 may shear at the same predetermined amount of pressure or at different predetermined amounts of pressure without departing from the scope of the present disclosure.

Still referring to FIG. 1, cone ramp 22 facilitates the radial outward expansion of the plurality of slips 18. That is, once actuated, the cone 14 slides toward the slip cage 12 in a longitudinal direction along the length of the body of the tool assembly 10. In other embodiments of the present disclosure, the slip cage 12 may slide towards the cone 14, or the slip cage 12 and the cone 14 may slide towards each other without departing from the scope of the present disclosure. This sliding action causes the plurality of slips 18 carried by the slip cage 12 to ride up the cone ramp 22 of the cone 14 as the plurality of slips 18 expands in a radially outward direction to grip a casing or other tubular in which the tool assembly 10 is set. As shown in FIG. 1, for example, the plurality of slips 18 may include a plurality of teeth 20 to facilitate gripping engagement with the casing or other tubular in which the tool assembly 10 is set, according to one or more embodiments of the present disclosure. However, the plurality of slips 18 may include wickers or another hardened surface to facilitate gripping the casing or other tubular without departing from the scope of the present disclosure.

As previously described, the shear bridge 16 according to one or more embodiments of the present disclosure connects the cone 14 and the slip cage 12 via a plurality of shear fasteners 30. In this way, the shear bridge 16 advantageously keeps the tool assembly 10 locked in its assembled configuration during transport (e.g., deployment, running in hole, etc.). Moreover, because the plurality of shear fasteners 30 that fasten the shear bridge 16 effectively lock the cone 14 and the slip cage 12, the shear bridge 16 prevents premature actuation of the tool assembly 10 until a predetermined amount of pressure is able to shear the plurality of shear fasteners 30, thereby unlocking the cone 14 and the slip cage 12. Once the plurality of shear fasteners 30 have sheared, the cone 14 may slide toward the slip cage 12, the slip cage 12 may slide toward the cone 14, or the slip cage 12 and the cone 14 may slide towards each other according to one or more embodiments of the present disclosure, thereby causing radial outward expansion of the plurality of slips 18, as previously described.

Advantageously, the shear bridge 16 according to one or more embodiments of the present disclosure facilitates connecting the cone 14 to the slip cage 12 in tool assemblies 10 (e.g., packer assemblies) in which the plurality of slips 18 includes single-ramp slips, for example. In this way, the shear bridge 16 according to one or more embodiments of the present disclosure accommodates the design constraints associated with single-ramp slips by connecting the cone 14 directly to the slip cage 12. The shear bridge 16 according to one or more embodiments of the present disclosure may be particularly useful in large-bore packer assemblies due to the limited space remaining between the mandrel (i.e., the body) and the casing in such assemblies.

During setting actuation, the shear bridge 16 according to one or more embodiments of the present disclosure has exhibited unexpected results and advantages over tool assemblies where the slip was directly linked to the cone via a shear screw. For example, during setting actuation, the shear bridge 16 according to one or more embodiments of the present disclosure exhibited minimal radial deformation of approximately 0.030 inch, and the bridge portion 24 of the shear bridge 16 exhibited no plastic strain, with such plastic strain advantageously being concentrated at the shear fastener 30 fastened to the slip cage 12 near the end of the bridge portion 24 that is opposite the ring portion 26. Moreover, test results have shown that the shear bridge 16 according to one or more embodiments of the present disclosure was able to accommodate a maximum ambient shearing load, which may bode well for shearing loads experienced in downhole conditions.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tool assembly comprising:
- a body;
- a slip cage disposed about the body, the slip cage carrying a plurality of slips;
- a cone slidable in a longitudinal direction along a length of the body, the cone comprising:
  - a ramp that facilitates radial outward expansion of the plurality of slips; and
  - a shear bridge that connects the cone and the slip cage via a plurality of shear fasteners, wherein the shear bridge comprises:
    - a plurality of bridge portions joined together via a ring portion;
    - at least one hole at an interface between the ring portion and a given bridge portion of the plurality of bridge portions; and
    - a second hole near an end of the given bridge portion that is opposite the ring portion,
  - wherein a first shear fastener of the plurality of shear fasteners is disposed in the at least one hole for holding the shear bridge axially to the cone, and
  - wherein a second shear fastener of the plurality of shear fasteners is disposed in the second hole for fastening the given bridge portion of the shear bridge to the slip cage.

2. The tool assembly of claim 1, wherein the first shear fastener is selected from the group consisting of: a shear pin; and a shear screw.

3. The tool assembly of claim 2, wherein the second shear fastener is selected from the group consisting of: a shear pin; and a shear screw.

4. The tool assembly of claim 1, wherein the second shear fastener is selected from the group consisting of: a shear pin; and a shear screw.

5. The tool assembly of claim 1, wherein the tool assembly is a packer assembly.

6. A method, comprising:
- deploying the tool assembly of claim 1 into a cased wellbore, wherein the plurality of slips comprises a plurality of teeth;
- shearing the first shear fastener and the second shear fastener; and radially outwardly expanding at least one slip of the plurality of slips such that the plurality of teeth bite into the casing.

7. The method of claim 6, wherein the shearing step comprises shearing the first shear fastener and the second shear fastener at a predetermined pressure.

8. The method of claim 6, wherein the tool assembly is a packer.

* * * * *